US005199446A

United States Patent [19]

Cahill et al.

[11] Patent Number: 5,199,446

[45] Date of Patent: Apr. 6, 1993

[54] CIGARETTE MAKING MACHINE

[75] Inventors: Michael J. Cahill; John Dawson, both of Coventry, England

[73] Assignee: Molins PLC, Milton Keynes, United Kingdom

[21] Appl. No.: 729,889

[22] Filed: Jul. 11, 1991

Related U.S. Application Data

[63] Continuation of Ser. No. 377,521, Jul. 10, 1989, abandoned.

[30] Foreign Application Priority Data

Jul. 12, 1988 [GB] United Kingdom ..... 8816538
Sep. 30, 1988 [GB] United Kingdom ..... 8823013

[51] Int. Cl.[5] ..... A24C 5/18

[52] U.S. Cl. ..... 131/84.1; 131/84.3; 131/109.1

[58] Field of Search ..... 131/84.1, 84.2, 84.3, 131/84.4, 108, 109.1, 109.2, 110

[56] References Cited

U.S. PATENT DOCUMENTS 3,795,249 3/1974 Cristiani ..... 131/84.1
4,616,662 10/1986 Hartmann et al. ..... 131/84.1
4,736,754 4/1988 Heitmann et al. ..... 131/84.3

FOREIGN PATENT DOCUMENTS 2150008 10/1984 United Kingdom .

*Primary Examiner*—V. Millin
*Assistant Examiner*—J. Doyle
*Attorney, Agent, or Firm*—Antonelli, Terry, Stout & Kraus

[57] ABSTRACT

A cigarette making machine includes a shower channel (10; 46; 59; 75; 90; 102; 113; 121) through which tobacco is arranged to be showered towards two suction bands (11,12; 66,67; 76,77; 103,104; 114,115) arranged to move towards one another so as to form two tobacco sub-streams (13,14; 78,79) from the showered tobacco and to bring these streams together in a region (15) where the bands are closest.

15 Claims, 7 Drawing Sheets

CIGARETTE MAKING MACHINE

This application is a continuation of application Ser. No. 377,521, filed Jul. 10, 1989, abandoned on the filing of the instant application.

Cigarette making machines commonly form a cigarette filler stream by showering tobacco through a channel towards a suction band running across the downstream end of the channel. Tobacco collects on the suction band and is held on the band by suction transmitted through the band. While suctionally compressed, the filler stream is usually trimmed to remove excess tobacco, and is then deposited upon a continuous wrapper web carried by a garniture tape through a garniture (rod-forming device) in which, with the aid of the garniture tape, the wrapper web is sealed around the filler stream. While passing through the garniture, the filler stream is compressed and its cross-section changes from a rectangular shape to the circular shape of the finished cigarette.

An example of a machine embodying principles commonly used until now is shown in our U.S. Pat. No. 3,019,793. More recent proposals are described in our British patent application No. 2179840 and corresponding U.S. Pat. No. 4,742,834; these include a proposal for showering tobacco towards a suction band in a direction having a substantial component (a "forward component") in the direction of movement of the suction band, and a proposal for showering tobacco through two separate channels which converge in the region of the suction band.

According to the present invention, a cigarette making machine includes a shower channel through which tobacco is arranged to be showered towards two suction bands arranged to move towards one another so as to form two tobacco sub-streams from the showered tobacco and to bring those streams together in the region where the bands are closest. The bands, in the regions where they receive the showered tobacco, preferably converge towards one another so that each is inclined to the direction in which the tobacco is showered, such that the showered tobacco arrives at each band while moving in a direction having a component in the direction of movement of the band (i.e. a "forward component"). The point at which the two streams merge (the "merger point") preferably lies substantially centrally with respect to the shower channel, so that substantially equal amounts of tobacco are showered onto the respective bands.

The "forward component" tobacco shower with respect to each band is beneficial for reasons which we have previously recognised but achieved only in connection with a single band. The use of two converging bands in accordance with the present invention has further advantages, notably in that the cigarette filler stream formed by merging the two sub-streams conveyed by the two bands is substantially symmetrical with respect to the density of tobacco: whereas, in a conventional machine, the tobacco density is greatest on one side (closest to the suction band), the present invention enables the tobacco density to be substantially equal at least on opposite sides of the filler stream and possibly substantially around the entire periphery of the filler stream.

In a preferred construction, the two suction bands (or at least their respective edges) continue to converge slightly after the merger point. The continued convergence serves to compress and preferably also to shape the combined tobacco stream. For the purpose of shaping the stream, the bands' are preferably formed from woven fibrous material so as to have transverse flexibility, and are arranged to have slightly concave cross-sections, at least in the region downstream of the merger point, so as to progressively shape and compress the combined tobacco stream. Thus the sides of the combined stream adjacent to the two bands may begin to be shaped towards the final circular cross-section of the finished cigarette, final shaping being possibly achieved in a garniture with the aid of a garniture tape and tongue basically in accordance with existing practices.

Examples of machines according to this invention are shown in the accompanying diagrammatic drawings. In these drawings:

FIG. 5A is an enlarged view of the portion in FIG. 5 where the streams merge;

FIG. 8 shows a possible modification of the machine shown in

Figure 4:
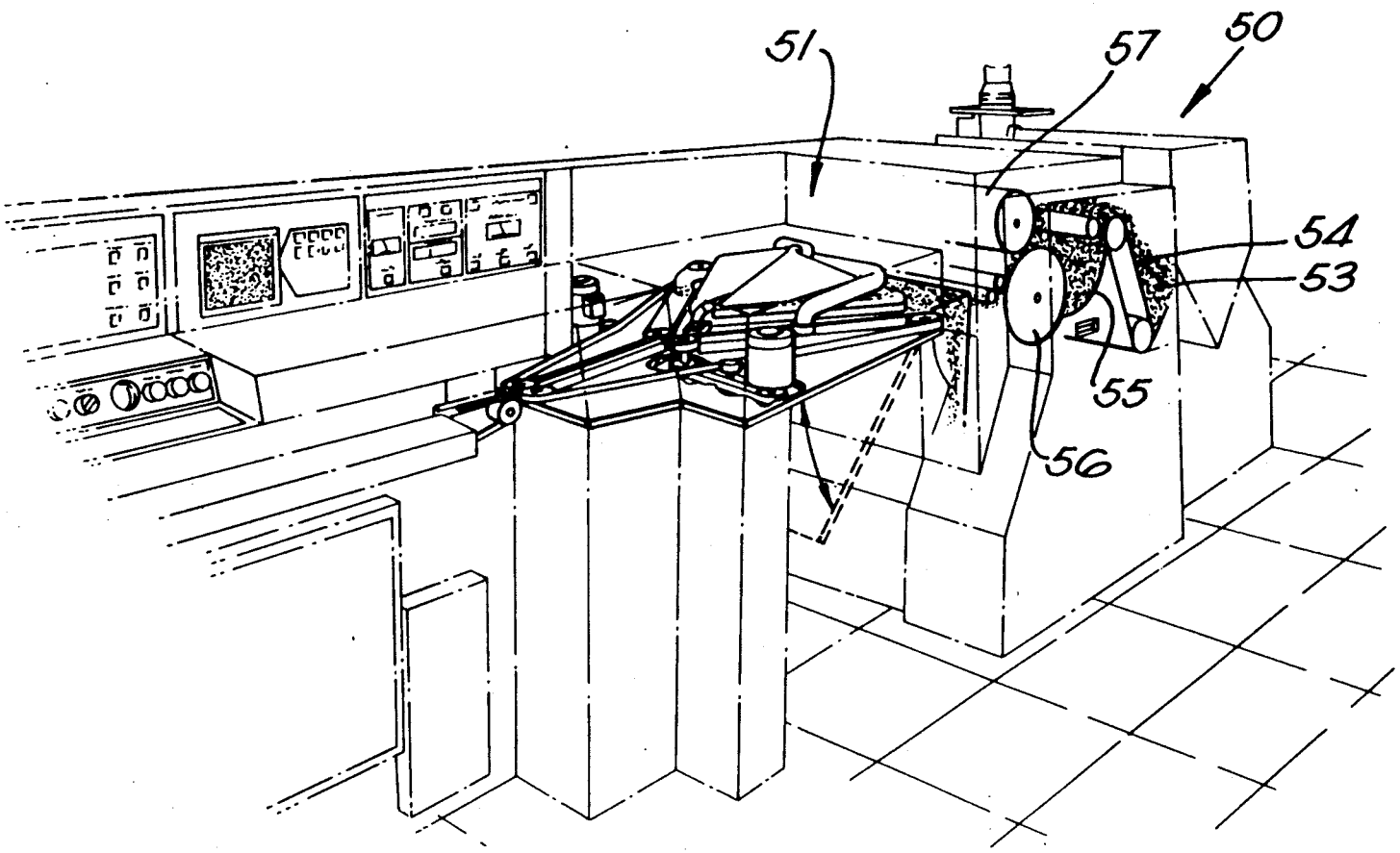
FIG. 4 is a perspective view of another machine.
Figure 5:
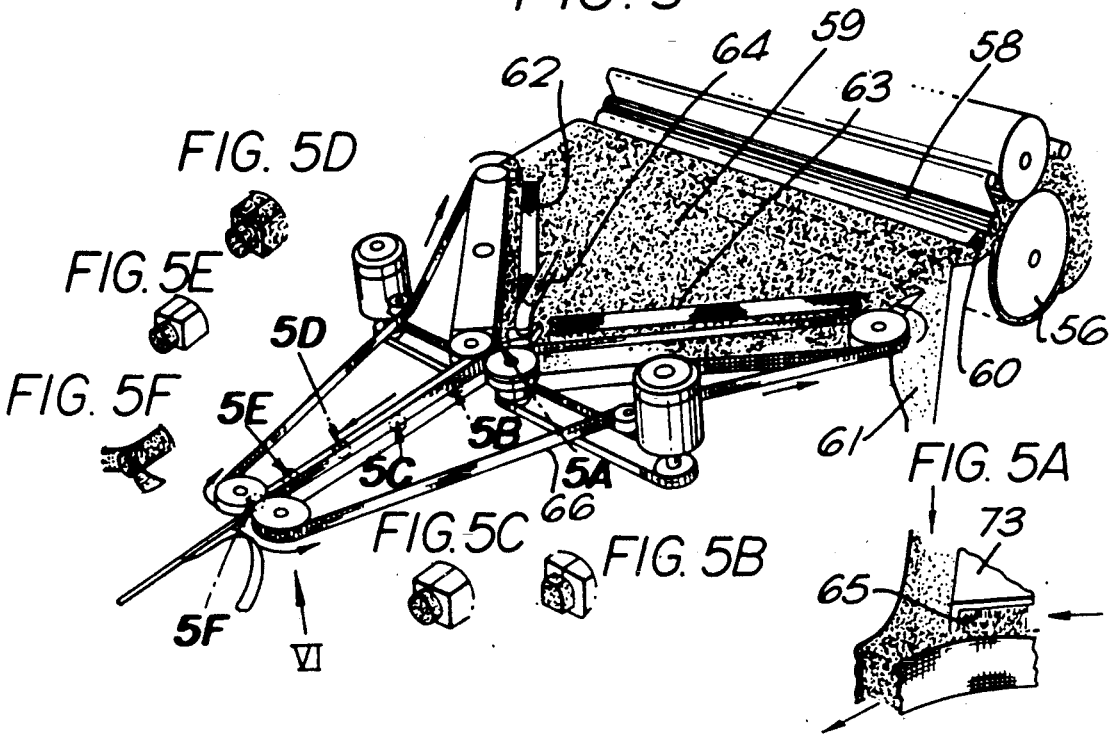
FIG. 5 is an enlargement in perspective of part of the machine shown in FIG. 4.
Figure 6:
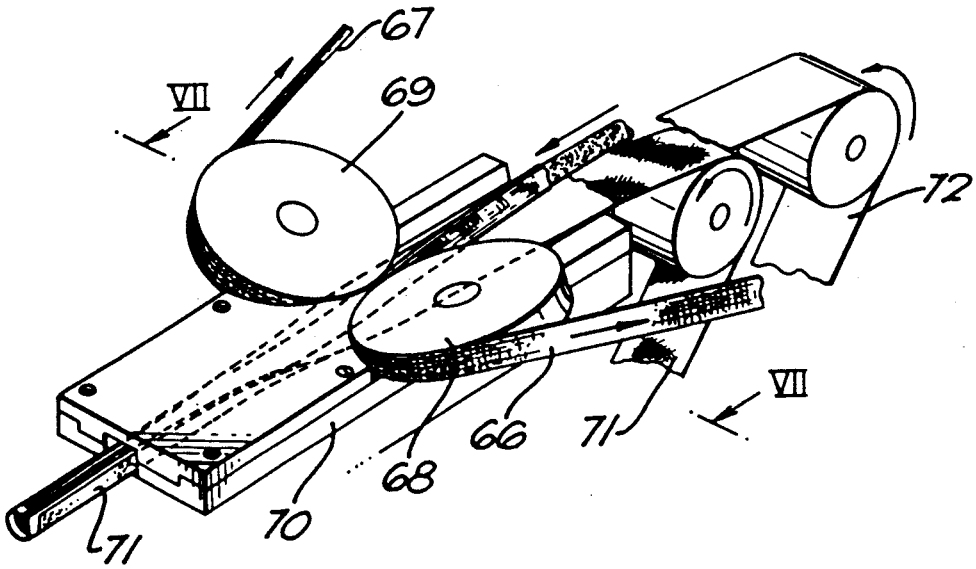
FIG. 6 is a further enlargement of part of the machine shown in FIGS. 4 and 5.
Figure 9:
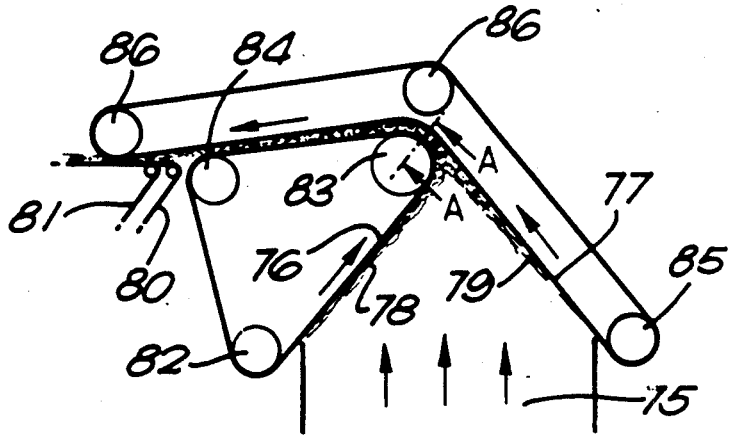
Figure 10:
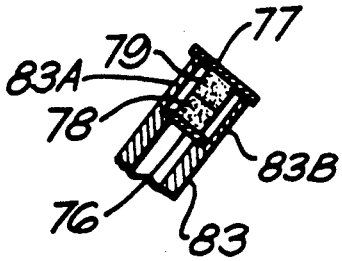

FIGS. 4 to 6, especially in regard to the means for feeding tobacco into the shower channel and for winnowing the tobacco;

FIG. 9 is a front elevator of another machine;

FIG. 10 is an enlarged section on the line A—A in FIG. 9; and

FIGS. 11 to 15 show other different layouts of machines according to this invention.

Figure 1:
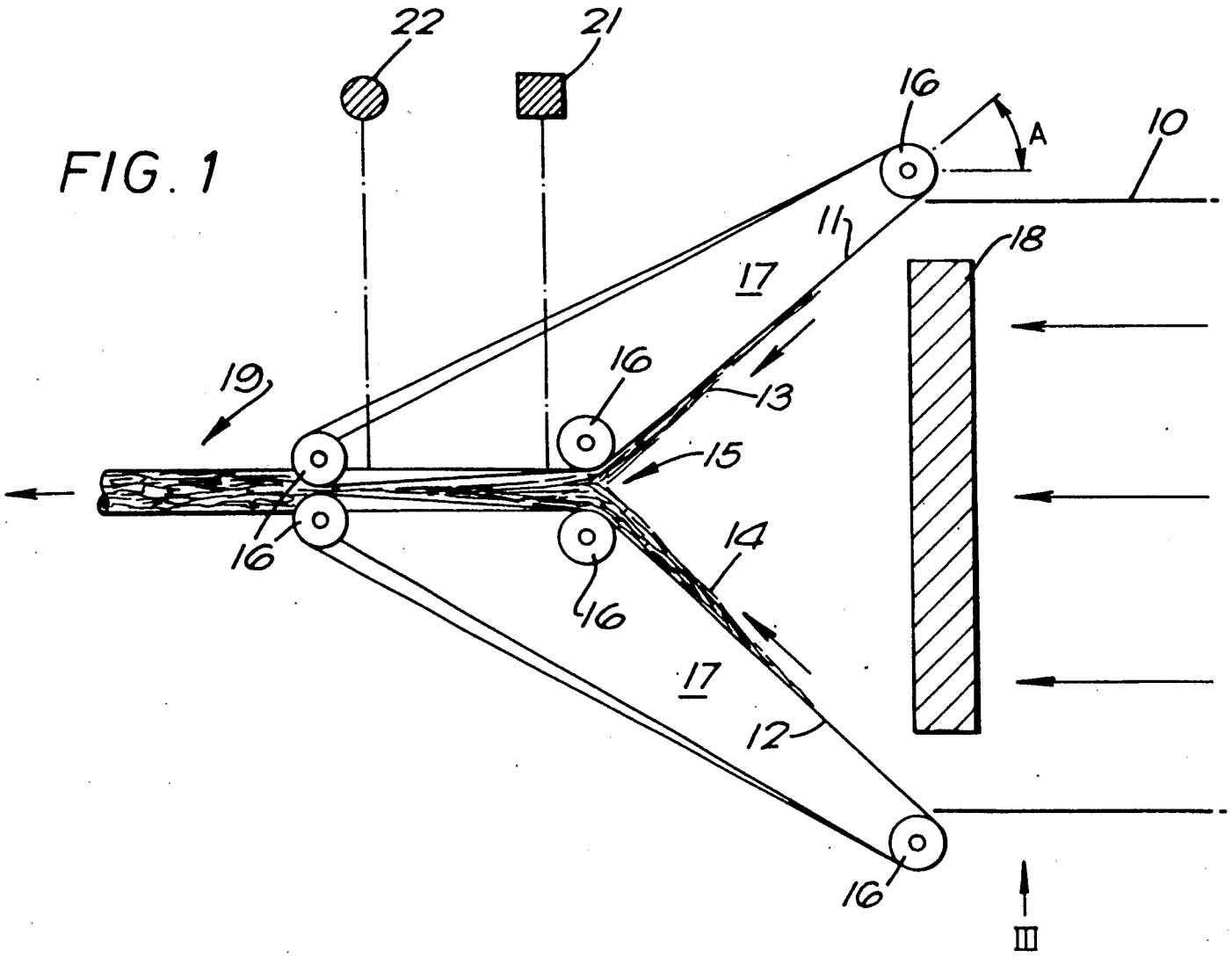
FIG. 1 is a plan view of one machine.

FIG. 1 shows a machine in which tobacco is showered through a shower channel 10 towards suction bands 11 and 12 arranged to form two tobacco streams 13 and 14 from the showered tobacco, these streams being merged at a merger point 15. The bands pass around pulleys 16 and their paths extend around suction chambers 17 from which suction is applied through the bands to hold the tobacco on the bands. Some of the air used to convey the tobacco through the channel 10 is extracted through a supercharger louvre 18 in one wall of the channel 10.

While being conveyed from the merger point 15 to a rod-forming area (garniture) identified generally as 19, the merged tobacco stream is shaped (and preferably also reduced progressively in cross-section) as a result of the bands being constrained by guides (not shown) to change from flat cross-sections to approximately semicircular cross-sections; the cross-sections of the tobacco stream at two positions are shown approximately by the sectional illustrations 21 and 22 respectively.

It should be noted that the regions of the bands 11 on which the showered tobacco arrives from the channel 10 are inclined to the direction of movement of the tobacco by the angle A. As shown in the drawing, angle A is approximately 40 degrees. Accordingly the tobacco arrives at the bands with a component of motion parallel to the bands equal to V cos A, where V is the velocity of the tobacco. This component may be increased by decreasing the angle A.

As an example of the way the merged and shaped tobacco stream may be handled after leaving the bands 11 and 12, FIG. 1 may be taken to be a plan view, and the wrapper web may be conveyed by a garniture tape along a path extending below the bands so that the tobacco emerging from the bands is deposited on the wrapper web and continues in substantially the same direction. Final shaping and compression of the tobacco stream may be achieved in a conventional manner by the action of a tongue lying above the tobacco stream and defining a progressively reducing cross-section for the tobacco stream so as to compress the stream while shaping it to the final cross-section of the cigarettes. Alternatively, the cross-section of the tobacco stream as it emerges from the bands may be substantially that of the finished cigarette.

The tobacco may be fed into the channel 10 by any known form of hopper. Instead of the tobacco being deflected from a horizontal motion to a vertical motion so as to pass up a vertical channel (a "chimney"), the tobacco may continue in a substantially horizontal direction to enter the shower channel 10 shown in FIG. 1.

The forward component of the tobacco shower in relation to the motion of the bands 11 and 12 has been found to result in a more uniform formation of tobacco on the bands, as well as in a more random orientation of the tobacco. The latter improves the firmness of the final cigarettes for a given density. In view of the improvement in the uniformity of the tobacco stream, it may be possible to omit the usual trimming. However, trimming may be achieved, for example in the way shown in FIG. 2.

Figure 2:
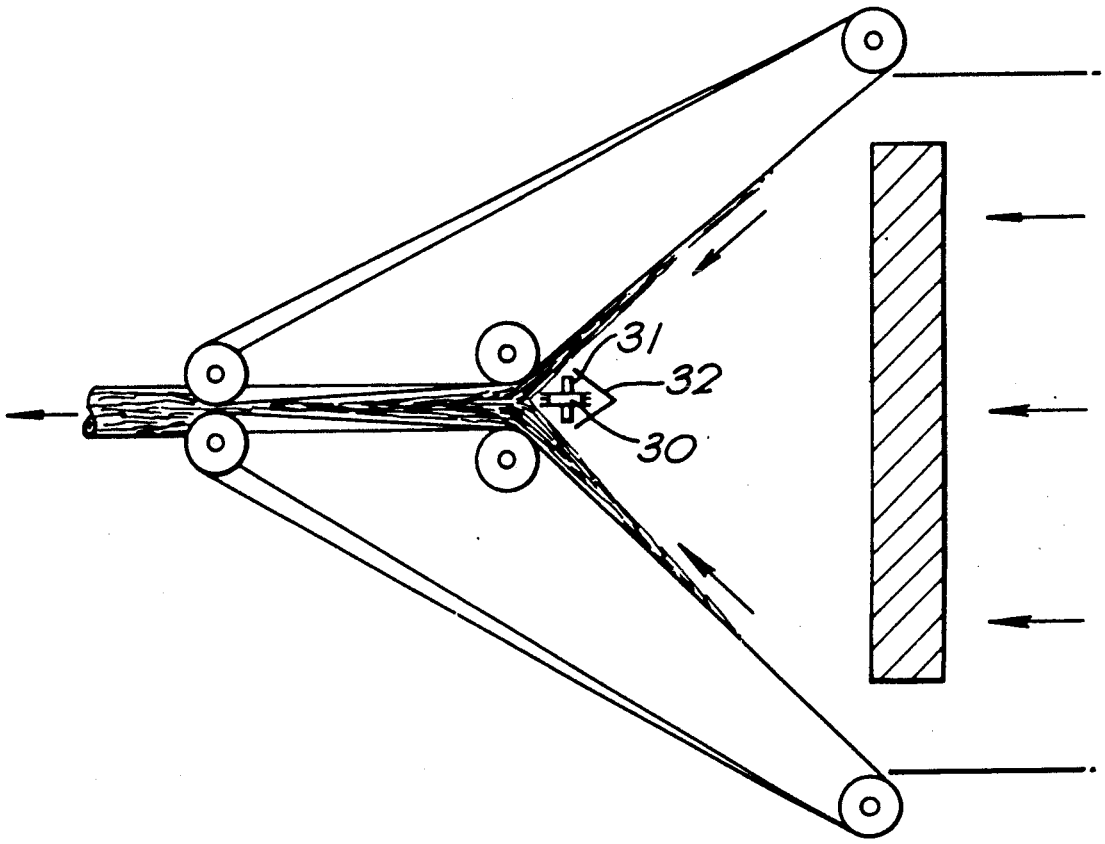
FIG. 2 is a plan view of a modified machine similar to that shown in FIG. 1.

FIG. 2 shows the same arrangement as FIG. 1 but with the addition of a pinned roller 30 mounted on a shaft 31 and having pins which remove in an upward or downward direction part of the tobacco arriving at the merger point 15 identified in FIG. 1. The position of the roller 30 is controlled in a direction transverse to the axis of the shaft 31 (horizontally) so as to control the amount of tobacco removed by the roller. This control may be achieved manually or may be automatic in response to a nucleonic or other device for monitoring the mass or density of the finished cigarette rod. A V-shaped cowl 32 encloses the roller 30 and deflects onto the suction bands 11 and 12 the tobacco which would otherwise arrive on the roller.

Alternatively each of the tobacco streams on the bands 11 and 12 may be trimmed separately, for example by means of pairs of discs in the conventional manner, the two pairs being inclined so that they can be close to the merger point 15 without interfering with one another.

Figure 3:
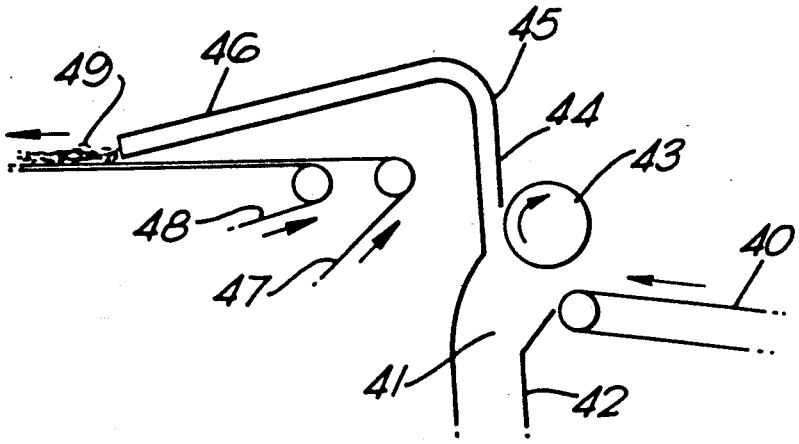
FIG. 3 is a view in the direction of the arrow III in FIG. 1.

FIG. 3 is a front view of the machine in the direction of the arrow III in FIG. 1 showing one possible way in which the apparatus of this invention may be incorporated into a cigarette making machine. The machine in this example includes a conveyor band 40 arranged to convey a carpet of tobacco into a winnowing chamber 41 from which heavy particles fall through a downwardly extending duct 42. Lighter particles of tobacco pass around a suction roller 43 and pass upwards into a shower channel comprising a vertical portion 44, a curved portion 45 and a downwardly inclined portion 46. The portion 46 includes the apparatus shown in FIG. 1. A cigarette filler stream emerging from the downstream end of the portion 46 of the shower channel is conveyed further on a wrapper web 47 with the aid of a garniture tape 48 by which the wrapper web is folded and sealed around the merged filler stream which is identified as 49.

Other forms of trimmer may instead be used, being for example located either in the position of the trimming roller 30 or in a position such as to remove excess tobacco from the tobacco stream after it emerges from the bands 11 and 12.

FIG. 4 is a perspective view of another machine which includes a hopper 50 and a rod-forming section 51, the latter being shown in more detail in FIGS. 5 and 6. The hopper includes a space 53 from which tobacco is fed upwards by a spiked elevator 54 onto a concave plate 55 on which a roll of tobacco is arranged to accumulate. A carded drum 56 feeds a measured quantity of tobacco upwards from the tobacco roll, the evenness of the feed being improved by a spiked refuser roller 57.

As shown in FIG. 5, the tobacco is removed from the carded roller 56 by a picker roller 58 and is accelerated by roller 59 into a shower channel 59 forming part of the rod-forming device identified generally in FIG. 4. On the way towards the shower channel, heavy particles of tobacco (pieces of stem etc) are allowed to fall out through a duct 61.

The rod-forming section is similar to that shown in FIGS. 1 and 2. However, it should be noted that in this example there are two "supercharger" louvres 62 and 63 parallel to respective converging bands 66 and 67. Also, an arrangement is shown for introducing additional tobacco into the merger point through a pipe 64, this being partially detailed in the enlarged view shown at 5A; the enlarged views 5B–5F show the change of cross-section of the tobacco stream at successive positions along the rod-forming section identified by the lead lines extending from the enlargements 5B–5F.

As shown in FIG. 5 and particularly in FIG. 5A, the duct 64 enters a hollow 4-sided body 73 having an outlet opening 65 on one side through which tobacco can pass onto the adjacent tobacco band 66. Tobacco may be fed continuously through the duct 64 in a variable quantity so as to maintain a substantially constant weight in the finished rod, the actual quantity being dependent upon a weight-monitoring device which may be of a conventional type. Alternatively, or in addition, tobacco may be fed into the duct 64 in a pulsed manner so as to coincide with end portions of the finished rod, thus producing denser end portions.

FIG. 6 is an enlarged view in the direction of the arrow VI in FIG. 5. It shows more particularly the bands 66 and 67 returning around pulleys 68 and 69 respectively. It should be noted that the axes of the pulleys are inclined towards one another in an upward direction to enable the pulleys themselves to clear a garniture bed 70 along which a garniture tape 71 runs along with a wrapper web 72 arranged to enclose the tobacco stream in a conventional manner.

Figure 7:
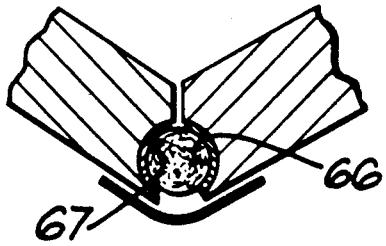
FIG. 7 is an enlarged section on the lines VII—VII in FIG. 6.

FIG. 7 is a section on the line VII—VII in FIG. 6 showing the cross-sectional shape of the bands 66 and 67 and of slightly modified pulleys 68 and 69 (each having an axis inclined by 20 degrees to the vertical) as the shaped (approximately circular) cigarette filler stream is about to be released onto the wrapper web 72.

As an alternative the wrapper web may be brought into initial engagement with the combined tobacco filler stream earlier, for example at or near the merger point.

Figure 8:
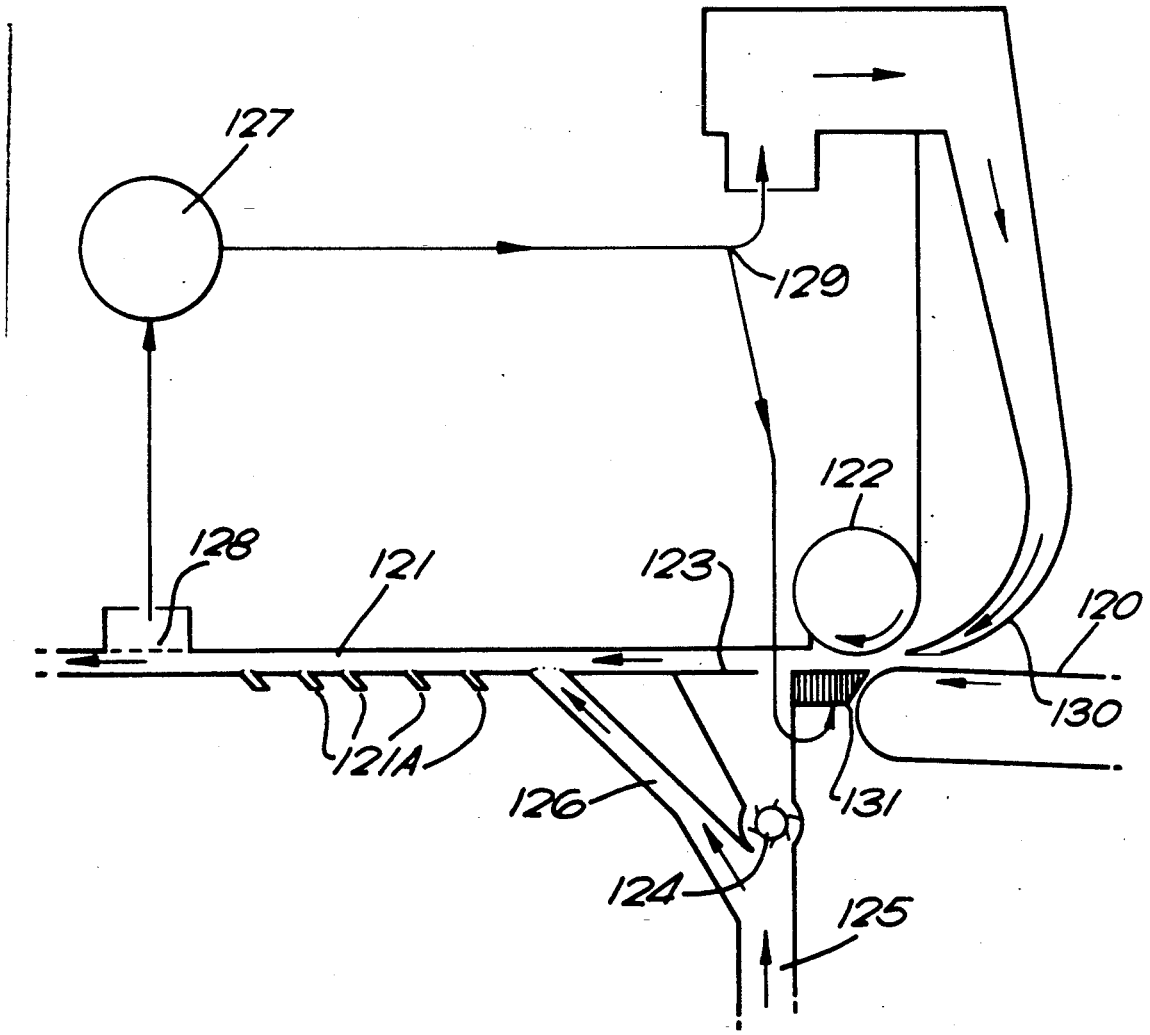

FIG. 8 shows an alternative means of feeding tobacco into the shower channel of a machine such as that shown in FIGS. 4 to 6. In this example the hopper meters tobacco onto a fast band 120 which delivers the tobacco into a shower channel 121, preferably with the aid of a projector roller 122. Heavy particles such as pieces of stem are separated by a separator plate 123 and then drop onto a roller 124, which passes such particles downwards at a controlled speed into a flotation chamber 125 in which secondary winnowing occurs by virtue of the fact that air is drawn up the chamber 125 and carries with it at least some of the lighter particles of tobacco which were entrained with heavier particles but are suitable for use in cigarettes. Air passing upwards through the flotation chamber enters the shower channel 121 via an inclined passage 126. The separator plate 123 may be adjustable in effective length and/or in inclination to adjust the proportion of tobacco separated by it. Most of the airflow through the shower channel 121 is produced by a supercharger fan 127 connected to one or two louvres 128 as described above. The air output from the fan is connected via a flow divider 129 (preferably adjustable) to a nozzle 130 and to air passages in a bridge member 131 across which the tobacco from the band 120 is projected. Air passing upwards from the member 131 tends to lift the tobacco while air from the nozzle 130 tends to propel the tobacco horizontally towards and into the shower channel 121.

The pressure in the shower channel is below atmospheric pressure. Inclined air inlets 121A in the lower wall of the shower channel result in air being drawn in from the atmosphere, and the air admitted in this way tends to lift the tobacco from the lower wall of the channel.

FIG. 9 shows a different machine in which a shower channel 75 extends vertically upwards towards two suction bands 76 and 77. After passing around the pulley 83, the bands move along substantially parallel paths along which they may change progressively from flat to concave cross-sections to shape the tobacco stream formed by sub-streams 78 and 79. As shown in FIG. 10, which is a section on the line A—A, the band 76 is narrow, being substantially the same width as the tobacco sub-stream 78 which forms on it. On the other hand, the band 77 is wider; the sub-stream 79 on it merges with the stream 78 to form the combined filler stream which is carried further by the band 77 to a position at which it is deposited upon a wrapper web 80 carried by a garniture tape 81.

The band 76 passes around three pulleys 82, 83 and 84 respectively, while the band 77 has three pulleys 85–87 and is also guided by the pulley 83. As shown in FIG. 10, the pulley 83 has flanges 83A and 83B which support the edges of the band 77 while it passes around the pulley 83, the filler stream portions 78 and 79 being contained between the flanges with slight clearances so that they remain on the band 77 as it proceeds towards the wrapper web, being held on the band 77 by suction.

Other details of the machine shown in FIGS. 9 and 10 may be similar to those described above, for example in regard to trimming and dense ending.

Figure 11:
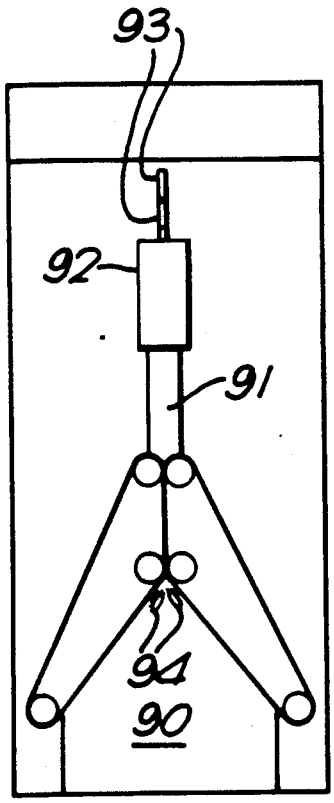

FIG. 11 shows a machine with a vertically extending shower channel 90 (as in FIG. 9), the combined filler streams being conveyed vertically beyond the merger point through a garniture 91 and further rod-forming and cutting devices 92 from which emerges a series of rods 93. Successive vertically moving rods are then received by a fluted catcher drum similar to that used in a conventional filter attachment machine, and are then carried horizontally (with their axes vertical) onto a suitable means for turning them into positions in which their axes are horizontal. Such turning means may, for example, comprise a conical fluted drum or a series of conical drums.

FIG. 11 also illustrates the provision of two trimmers 94 for the sub-streams on the two bands. Each trimmer comprises a circular disc having a conical peripheral surface carrying pins and is inclined to the plane of the shower channel so that only a small part of the disc needs to project into the channel to trim the tobacco in a plane parallel to the corresponding band.

Figure 12:
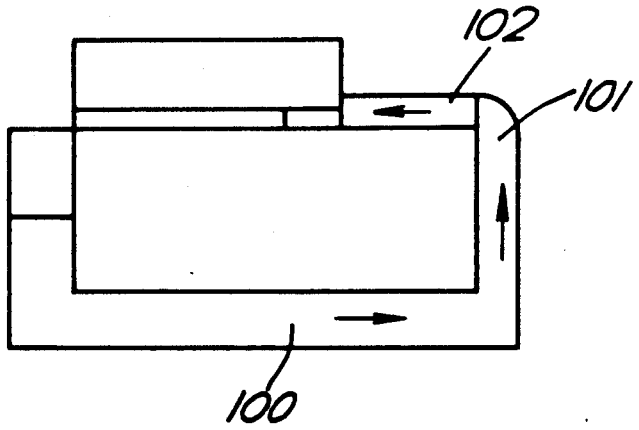
Figure 13:
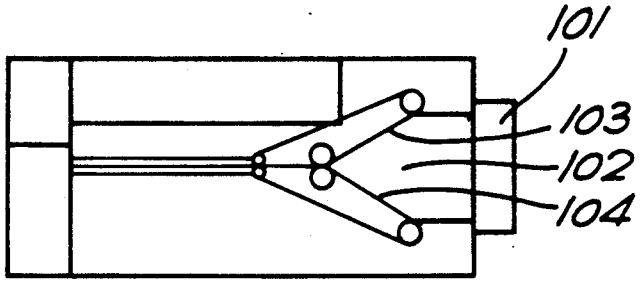

FIGS. 12 and 13 are respectively a side view and a plan view of a different machine. In this machine, a hopper 100 forms a stream of tobacco particles which is treated in any desired fashion, for example by sieving, sorting and re-combining selected particles of tobacco isolated by sieving. The tobacco is conveyed vertically upwards through a channel 101 and then horizontally into a shower channel 102 terminating in converging bands 103 and 104 in accordance with the present invention.

Figure 14:
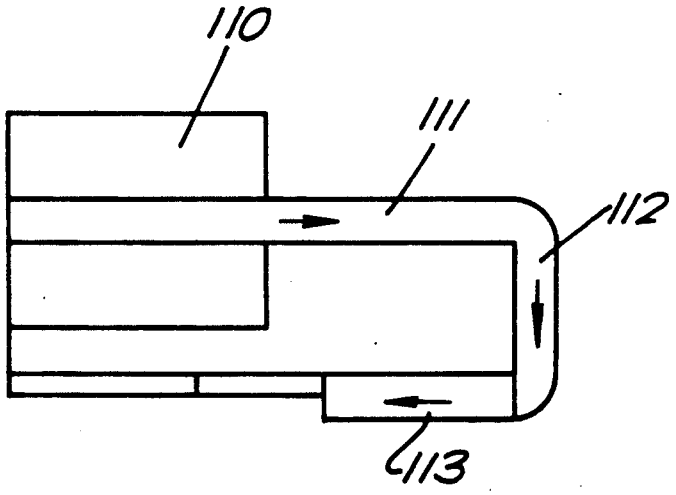
Figure 15:
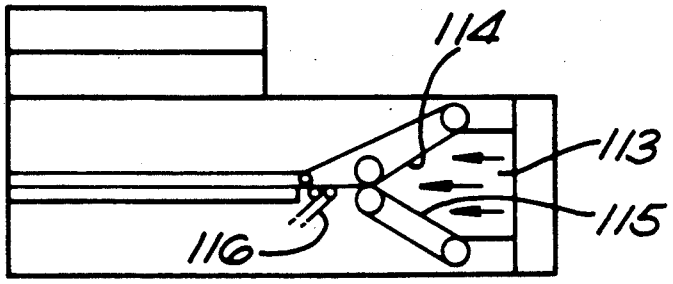

FIGS. 14 and 15 are respectively a plan view and a front view of a different machine. In this machine tobacco is fed from a hopper 110 to form a metered stream of tobacco which passes through a horizontally extending duct 111 and then through a further duct 112 before entering a shower channel 113 in accordance with this invention, including converging bands 114 and 115. The upper band 114 extends beyond the band 115 so as to carry the merged tobacco stream, by means of suction, to a position at which it deposits the stream on a wrapper web 116.

In general, control of the weight of the finished rod may be achieved partly or entirely by controlling the delivery of tobacco into the shower channel. Alternatively, or in addition, means may be provided by trimming either each individual shower stream (e.g. by means of pairs of cooperating discs in the well known manner) or as shown in FIG. 2. A further example, as mentioned above, involves the introduction of tobacco into the merger point at a controlled rate suitable to maintain a controlled density of the finished cigarette rod; such tobacco may be low quality tobacco or short particles of tobacco extracted elsewhere from the main flow of tobacco.

Instead of all the tobacco being showered through a common shower channel, there may be two separate shower channels fed from two separate portions of the tobacco hopper for feeding tobacco towards the two respective bands. The gap between the two shower channels allows accommodation for one or more trimmers or for the feed of weight-adjusting tobacco into the merger point.

The two tobacco bands in each example may be driven at identical speeds, or at slightly different speeds. For example, the two bands may be respectively 4% higher and lower in speed than the wrapper web. It is envisaged that, in this way, some degree of compensation for short-term variations in the tobacco flow can be achieved; that is to say, variations which would otherwise be directly reflected in the finished cigarette rod tend to be evened out since high points on one band are shifted with respect to corresponding high points on the other band.

One or both of the suction bands may be curved (concave) in cross-section upstream of the merger point as well as downstream.

Spaced quantities of tobacco for feeding into the merger point for "dense ending" may be formed by collecting tobacco on a wheel having a saw tooth periphery, e.g. as described with reference to FIG. 9 of our British patent No. 2170693.

The following modification may be made of the apparatus shown in FIG. 9. Instead of the shower channel lying in a vertical plane, it may lie in an approximately horizontal plane. The pulley is omitted so that the band 72 passes directly around the pulleys 82 and 83, the merged tobacco stream being carried entirely by the band 77 by means of suction. In this case, the portion of the longer band 77 may, as it moves from the merger point, twist through 90° in order to deposit the combined tobacco stream on a conventionally orientated wrapper web.

We claim:

1. A cigarette making machine including a shower channel through which tobacco is arranged to be showered toward two converging suction bands so as to form two continuous tobacco sub-streams on the respective bands and to merge these sub-streams, in a region where the bands are closest, to form one stream.

2. A cigarette making machine according to claim 1 in which the bands, in the region where they receive the showered tobacco, converge towards one another so that each is inclined to the direction in which the tobacco is showered, such that the showered tobacco arrives at each band while moving in a direction having a component in the direction of movement of the band.

3. A cigarette making machine according to claim 1 in which the point at which the two sub-streams merge lies centrally with respect to the shower channel, substantially equal quantities of tobacco being showered onto the respective bands.

4. A cigarette making machine according to claim 1 in which the bands are arranged to move along approximately parallel paths beyond the point at which the two sub-streams merge, the paths of the bands and/or their cross-sections at successive positions along the approximately parallel paths being such as to progressively compress the merged tobacco stream.

5. A cigarette making machine according to claim 4 in which the cross-sectional shapes of the bands are constrained to change progressively towards approximately semi-circular shapes.

6. A cigarette making machine according to claim 5 in which the semi-circular shapes of the bands at the ends of the approximately parallel path sections each have a radius approximately equal to, or only slightly greater than, the radius of the finished cigarette rod.

7. A cigarette making machine according to claim 1 in which the shower channel lies in an approximately horizontal plane whereby the two tobacco sub-streams form the sides of the merged cigarette filler stream, and including means for conveying below the merged stream a continuous wrapper web on which the merged stream is deposited, and means for wrapping and sealing the web around the merged stream to form a continuous cigarette rod.

8. A cigarette making machine according to claim 1 including means for trimming each tobacco sub-stream or the merged stream.

9. A cigarette making machine according to claim 1 including means for feeding additional tobacco or other material between the two tobacco sub-streams at the merger point.

10. A cigarette making machine according to claim 9 in which the feed means is arranged to feed additional tobacco intermittently to coincide with the cigarette end portions of the tobacco stream, so as to form cigarettes with denser end portions.

11. A cigarette making machine according to claim 1 in which the showered tobacco is conveyed pneumatically through the shower channel, at least part of the air flow through the channel being induced by suction applied through one or more louvres in a wall of the shower channel.

12. A method of making cigarettes comprising the steps of showering tobacco onto two converging bands through a common channel so as to form continuous and substantially equal tobacco sub-streams on the two bands, merging the two continuous and substantially equal sub-streams to form a cigarette filler stream, trimming either the sub-streams or the merged stream, enclosing the merged stream in a continuous wrapper web to form a continuous cigarette rod, and then cutting the continuous rod at regular intervals to form individual rods.

13. A cigarette making machine comprising two suction bands having respective portions in close proximity, a common shower channel through which tobacco is arranged to be showered towards both suction bands so as to form two continuous tobacco sub-streams on the respective bands, these sub-streams being merged, in said region where the bands are in close proximity, to form one stream.

14. A cigarette making machine including means for showering tobacco in a substantially predetermined direction towards two converging suction bands which are respectively inclined in relation to the said predetermined direction in opposite senses, whereby the showered tobacco arrives at each band with a component of motion in the direction of movement of the respective band so as to form two continuous tobacco sub-streams on the respective bands and to merge these sub-streams, in a region where the bands are closest, to form one stream.

15. A method of making cigarettes comprising the steps of showering tobacco in a substantially predetermined direction onto two converging bands along portions thereof inclined in opposite senses relative to the said predetermined direction, whereby tobacco arrives on each band with a component of motion in the direction of movement of the respective band, so as to form substantially equal tobacco sub-streams on the two bands, merging the two continuous and substantially equal sub-streams to form a cigarette filler stream, enclosing the merged stream in a continuous wrapper web to form a continuous cigarette rod, and then cutting the continuous rod at regular intervals to form individual rods.

* * * * *